US006966938B2

(12) United States Patent
Bürgin et al.

(10) Patent No.: US 6,966,938 B2
(45) Date of Patent: Nov. 22, 2005

(54) OIL SEPARATOR FOR PUMPS OVERFLOWING WITH OIL

(75) Inventors: Andreas Bürgin, Fischingen (DE); Markus Kuny, Rheinfelden (DE)

(73) Assignee: Werner Rietschle GmbH & Co. KG, Schopfheim (DE)

( * ) Notice: Subject to any disclaimer, the term of this patent is extended or adjusted under 35 U.S.C. 154(b) by 0 days.

(21) Appl. No.: 10/468,360

(22) PCT Filed: Feb. 22, 2002

(86) PCT No.: PCT/EP02/01933

§ 371 (c)(1),
(2), (4) Date: Aug. 19, 2003

(87) PCT Pub. No.: WO02/068091

PCT Pub. Date: Sep. 6, 2002

(65) Prior Publication Data

US 2004/0068969 A1 Apr. 15, 2004

(30) Foreign Application Priority Data

Feb. 23, 2001 (DE) ..... 201 03 261 U

(51) Int. Cl.[7] ..... B01D 46/24

(52) U.S. Cl. ..... 55/482; 55/486; 55/487; 55/498; 55/502; 55/504; 55/510; 95/143; 95/286; 95/287; 96/189; 96/190; 96/191; 210/497.01; 210/DIG. 5

(58) Field of Search ..... 55/385.3, 498, 55/502, 503, 504, 482, 486, 487, 510; 123/198 E; 220/324; 210/232, 238, 497.01, DIG. 5; 95/143, 286, 287, 189, 190, 191

(56) References Cited

U.S. PATENT DOCUMENTS

| | | | | |
|---|---|---|---|---|
| 5,800,584 | A * | 9/1998 | Hinderer et al. | 55/482 |
| 5,803,954 | A * | 9/1998 | Gunter et al. | 95/268 |
| 6,214,077 | B1 * | 4/2001 | Bitner et al. | 55/490 |
| 6,299,661 | B1 * | 10/2001 | Bloomer | 55/385.3 |
| 6,402,798 | B1 * | 6/2002 | Kallsen et al. | 55/385.3 |
| 6,770,110 | B1 * | 8/2004 | Seifert et al. | 55/498 |

FOREIGN PATENT DOCUMENTS

| | | |
|---|---|---|
| DE | 1 403 568 | 6/1961 |
| DE | 34 45 400 | 6/1986 |
| DE | 198 23 339 | 12/1999 |
| EP | 1 034 830 | 9/2000 |
| GB | 991 570 | 5/1965 |

* cited by examiner

*Primary Examiner*—Duane Smith
*Assistant Examiner*—Minh-Chau T. Pham
(74) *Attorney, Agent, or Firm*—Stuart J. Friedman

(57) ABSTRACT

An oil separator for oil-flooded rotary vane vacuum pumps has a filter housing (10) and a plurality of filter cartridges (14) disposed therein through which the pumping medium flows. The filter cartridges (14) are each inserted through a respective opening (16) in an outer housing wall (12) of the filter housing (10) and are secured to the housing wall (12) so as to be detachable and tight with respect to media.

41 Claims, 1 Drawing Sheet

OIL SEPARATOR FOR PUMPS OVERFLOWING WITH OIL

FIELD OF THE INVENTION

The present invention relates to an oil separator for oil-flooded pumps, in particular rotary vane vacuum pumps, comprising a filter housing and a plurality of filter cartridges disposed therein through which the pumping medium flows.

BACKGROUND OF THE INVENTION

In oil-flooded pumps, in particular rotary vane vacuum pumps, the pumping medium is directed through an oil separator on the delivery side of the pump in order to separate it from oil carried along with the medium and to recycle the oil into the oil bath. The oil separator is essentially formed by a set of filter cartridges which are disposed in a filter housing and through which the pumping medium flows. The filter cartridges need to be replaced at regular intervals. The filter housing has a housing cover or a special maintenance cover which can be removed after a few fastening screws have been unscrewed for providing access to the filter cartridges. Each filter cartridge is secured in the filter housing by a threaded plastic holder. Once the plastic holder has been released, the filter cartridge can be pulled out of the filter housing.

SUMMARY OF THE INVENTION

The invention provides an oil separator for oil-flooded pumps which substantially facilitates the replacement of the filter cartridges. According to the invention, the filter cartridges are each inserted through a respective opening in an outer housing wall of the filter housing and are secured to the housing wall so as to be detachable and tight with respect to media. In this way, each filter cartridge is accessible directly at the housing wall of the filter housing so that it is not necessary to remove a housing lid or maintenance cover when the filters are replaced. This greatly simplifies the replacement of the filter cartridges.

In a convenient configuration of the attachment of the filter cartridges to the housing wall of the filter housing, such replacement can be accomplished quickly and effortlessly. In the preferred embodiment, each of the filter cartridges is secured to the housing wall by a screw-type or bayonet-type lock. The form-fit formations provided on the housing wall of the filter housing which are required for this type of attachment means are preferably formed not directly on the housing wall itself, but rather on mounting rings inserted therein. This measure simplifies the manufacture of the filter housing.

BRIEF DESCRIPTION OF THE DRAWINGS

Further features and advantages of the invention will be apparent from the description given below of a preferred embodiment and from the accompanying drawings to which reference is made and in which.

DETAILED DESCRIPTION OF THE INVENTION

Figure 1:
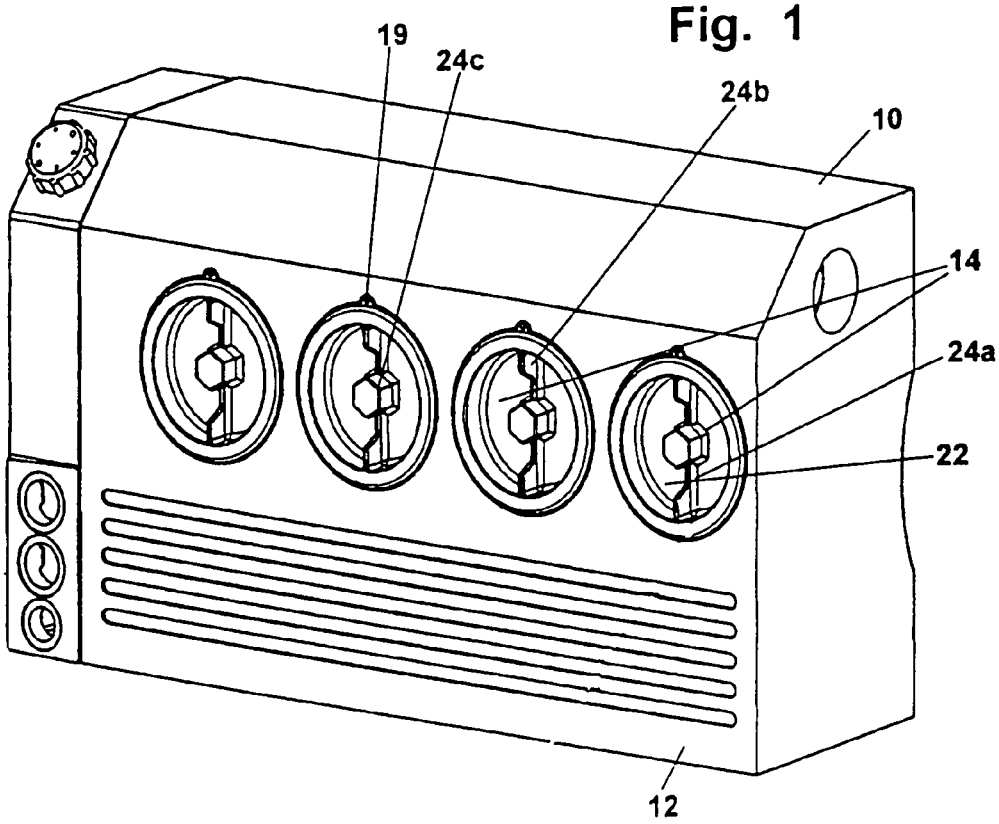
FIG. 1 shows a diagrammatic perspective view of a filter housing with filter cartridges inserted through a housing wall.
Figure 2:
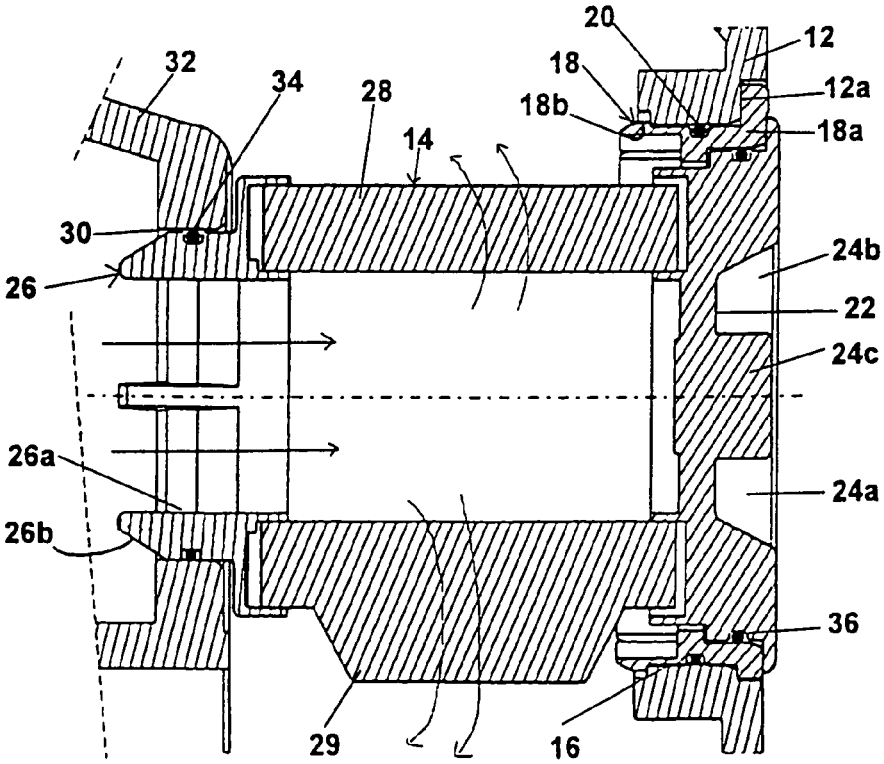
FIG. 2 shows a view of a section through a filter cartridge and the adjacent wall parts of the filter housing.

The filter housing 10 shown in FIG. 1 belongs to an oil-flooded rotary vane vacuum pump (not shown) and is applied to the side of the pump structure. The generally parallelepipedal filter housing 10 has an outside housing wall 12 through which four filter cartridges 14 are inserted. Access to the filter cartridges 14 is provided directly on the housing wall 12. The filter cartridges 14 are each detachably secured to the housing wall 12 by a bayonet-type or screw-type lock and so as to be tight with respect to media.

The housing wall 12 has a circular through opening 16 for each of the filter cartridges 14. Each through opening 16 has a mounting ring 18 inserted therein. The mounting ring 18 has a short, hollow cylindrical muff having a peripheral groove in which a sealing ring 20 is placed. The mounting ring 18 further has an annular flange 18*a* which is inserted in an appropriate recess 12*a* of the housing wall 12 so as to be flush with it. Furthermore, the mounting ring 18 is provided with latching members 18*b* engaging the inner side of the housing wall 12 so that the mounting ring 18 is fixed in place in the housing wall 12 by means of the annular flange 18*a* and the latching members 18*b*. The defined rotational position of each mounting ring 18 in its associated through opening 16 is determined by an integrally formed knob 19 which engages in a respective notch of the through opening 16.

The mounting ring 18 receives an outer end piece 22 of the filter cartridge 14 and is provided with form-fit formations on the inside which cooperate with corresponding outer form-fit formations on the end piece 22 in the form of a screw-type or bayonet-type lock. The lock has a pitch such that when the filter cartridge 14 is rotated it forces the latter to make a slight axial movement at the same time. The lock further has a stop for ensuring a defined rotational position of the filter cartridge 14 in the final position thereof. In addition, a grip 24*a*, 24*b* is integrally formed on the outside of the end piece 22, the grip being in the form of radial ribs with a central hexagonal member 24*c* being disposed in between for engagement by a tool if required. A hollow cylindrical filter body 28 of the filter cartridge 14 is arranged between the outer end piece 22 and a generally annular inner end piece 26. The end piece 26 is inserted in a through opening 30 of an inside wall 32 of the filter housing 10 which is opposite to the housing wall 12. The end piece 26 has a generally hollow cylindrical guide collar 26*a* having a peripheral groove in which a sealing ring 34 is inserted. The guide collar 26*a* is tapered toward its free axial end to form guide faces 26*b*. These guide faces 26*b* facilitate the insertion of the end piece 26 into the through opening 30 of the wall 32 from the outer side of the housing wall 12. The outer end piece 22 is also provided with a peripheral groove in which a sealing ring 36 is inserted. This sealing ring 36 seals at the inner periphery of the mounting ring 18. The sealing ring 34 seals at the inner periphery of the through opening 30 in the wall 32 of the filter housing 10. The filter body 28 of each filter cartridge 14 is provided with a drop collector 29 which in the correct fitting position protrudes vertically downward. For replacing the filter cartridges 14, the respective end pieces 22 are grasped at the grip 24*a*, 24*b* and turned counter-clockwise through 90°, resulting in the screw-type or bayonet-type lock to be released. In case of a tight fit of a filter cartridge, a conventional tool may be applied to the hexagonal member 24*c*. When the filter cartridge 14 is rotated, it is moved axially at the same time, forcing the sealing rings 34, 36 to execute a sliding movement on their sealing surfaces. Each filter cartridge 14 is then pulled axially out of the filter housing 10. A new filter cartridge is introduced through the mounting ring 18 and advanced against the wall 32; the guide faces 26*b* contact the inner rim of the through opening 30 and automatically lead the end piece 26 into the through opening 30. The fitting process for each filter cartridge is concluded by turning the outer end piece 22 clockwise through 90° as far as to the stop. In the rotational position now reached by each filter cartridge 14, its drop collector 29 is directed vertically downward, so that an optimum function is ensured.

What is claimed is:

1. An oil separator for oil-flooded pumps, comprising a filter housing and a plurality of filter cartridges therein through which the pumping medium flows, said filter housing comprising a housing wall in which a plurality of openings are provided, said filter cartridges being each inserted through a respective opening of said plurality of openings and being each secured to said housing wall so as to be detachable and tight with respect to media, said openings being each rimmed by a respective mounting ring when inserted in said housing wall, each of said mounting rings comprising a cylindrical wall portion and an annular flange portion being essentially perpendicular to said cylindrical wall portion, said annular flange portion being insertable in a recess of said housing wall, and, in the inserted state of said mounting ring, said annular flange portion being flush with said housing wall and said cylindrical wall portion lying against an inner side of said housing wall surrounding said opening, said annular flange portion and said cylindrical wall portion being embodied as a one-piece part.

2. The oil separator as set forth in claim 1, wherein said filter cartridges are each secured to said housing wall by a respective screw-type or bayonet-type lock.

3. The oil separator as set forth in claim 2, wherein said mounting ring is provided with form-fit variations for the screw-type or bayonet-type lock.

4. The oil separator as set forth in claim 3, wherein said mounting rings are secured to said housing wall by latching members engaging said inner side of said housing wall.

5. The oil separator as set forth in claim 1, wherein said mounting ring is sealed at said housing wall by at least one sealing ring.

6. The oil separator as set forth in claim 5, wherein said sealing ring is inserted in a peripheral groove of said mounting ring.

7. The oil separator as set forth in claim 1, wherein said filter cartridges each have an outer frontal end piece which is inserted in said mounting ring.

8. The oil separator as set forth in claim 7, wherein said outer frontal end piece is sealed at the mounting ring by at least one sealing ring.

9. The oil separator as set forth in claim 8, wherein said sealing ring is inserted in a peripheral groove of said outer frontal end piece.

10. The oil separator as set forth in claim 1, wherein each filter cartridge includes an inner end piece which is inserted in an opening of an inner housing wall of said filter housing.

11. The oil separator as set forth in claim 10, wherein said inner end piece has a hollow cylindrical guide collar which engages in said opening of said inner housing wall.

12. The oil separator as set forth in claim 11, wherein said guide collar has at least one peripheral groove in which a sealing ring is inserted.

13. The oil separator as set forth in claim 11, wherein said guide collar is tapered toward its free axial end to form guide faces.

14. The oil separator as set forth in claim 2, wherein said screw-type or bayonet-type lock has a pitch which forces said filter cartridge to move axially when it is rotated.

15. The oil separator as set forth in claim 2, wherein said screw-type or bayonet-type lock includes a stop to ensure a defined rotational position of said filter cartridge.

16. The oil separator as set forth in claim 1, wherein said mounting ring is held in a defined position at said housing wall by locking means preventing rotation.

17. An oil separator for oil-flooded pumps, comprising a filter housing and a plurality of filter cartridges therein through which the pumping medium flows, said filter housing comprising a housing wall in which a plurality of openings are provided, said filter cartridges being each inserted through a respective opening of said plurality of openings and being each secured to said housing wall so as to be detachable and tight with respect to media, said openings being each rimmed by a respective mounting ring when inserted in said housing wall, said filter cartridges each having an outer frontal end piece which is inserted in said mounting ring, said outer frontal end piece having a grip comprising radial ribs formed integrally therewith.

18. An oil separator according to claim 17, wherein said grip further comprises a central hexagonal member.

19. The oil separator as set forth in claim 17, wherein said filter cartridges are each secured to said housing wall by a respective screw-type or bayonet-type lock.

20. The oil separator as set forth in claim 19, wherein said mounting ring is provided with form-fit variations for the screw-type or bayonet-type lock.

21. The oil separator as set forth in claim 20, wherein said mounting rings are secured to said housing wall by latching members engaging the inner side of said housing wall.

22. The oil separator as set forth in claim 17, wherein said mounting ring is sealed at said housing wall by at least one sealing ring.

23. The oil separator as set forth in claim 22, wherein said sealing ring is inserted in a peripheral groove of said mounting ring.

24. The oil separator as set forth in claim 19, wherein said screw-type or bayonet-type lock has a pitch which forces said filter cartridge to move axially when it is rotated.

25. The oil separator as set forth in claim 19, wherein said screw-type or bayonet-type lock includes a stop to ensure a defined rotational position of said filter cartridge.

26. The oil separator as set forth in claim 17, wherein said mounting ring is held in a defined position at said housing wall by locking means preventing rotation.

27. An oil separator for oil-flooded pumps, comprising a filter housing and a plurality of filter cartridges therein through which the pumping medium flows, said filter housing comprising a housing wall in which a plurality of openings are provided, said filter cartridges being each inserted through a respective opening of said plurality of openings and being each secured to said housing wall so as to be detachable and tight with respect to media, said openings being each rimmed by a respective mounting ring inserted in said housing wall, said filter cartridges each having an outer frontal end piece which is inserted in said mounting ring, said outer frontal end piece and said mounting ring being configured as to tightly close said opening.

28. The oil separator according to claim 27, wherein said outer frontal end piece is sealed at said mounting ring by at least one sealing ring.

29. The oil separator according to claim 28, wherein said sealing ring is inserted in a peripheral groove of said outer frontal end piece.

30. The oil separator as set forth in claim 27, wherein said filter cartridges are each secured to said housing wall by a respective screw-type or bayonet-type lock.

31. The oil separator as set forth in claim 30, wherein said mounting ring is provided with form-fit variations for the screw-type or bayonet-type lock.

32. The oil separator as set forth in claim 27, wherein said mounting rings are secured to said housing wall by latching members engaging said inner side of said housing wall.

33. The oil separator as set forth in claim 27, wherein said mounting ring is sealed at said housing wall by at least one sealing ring.

34. The oil separator as set forth in claim 33, wherein said sealing ring is inserted in a peripheral groove of said mounting ring.

35. The oil separator as set forth in claim 27, wherein each filter cartridge includes an inner end piece which is inserted in an opening of an inner housing wall of said filter housing.

36. The oil separator as set forth in claim 35, wherein said inner end piece has a hollow cylindrical guide collar which engages in said opening of said inner housing wall.

37. The oil separator as set forth in claim 36, wherein said guide collar has at least one peripheral groove in which a sealing ring is inserted.

38. The oil separator as set forth in claim 36, wherein said guide collar is tapered toward its free axial end to form guide faces.

39. The oil separator as set forth in claim 30, wherein said screw-type or bayonet-type lock has a pitch which forces said filter cartridge to move axially when it is rotated.

40. The oil separator as set forth in claim 30, wherein said screw-type or bayonet-type lock includes a stop to ensure a defined rotational position of said filter cartridge.

41. The oil separator as set forth in claim 27, wherein said mounting ring is held in a defined position at said housing wall by locking means preventing rotation.

* * * * *